US006990887B1

(12) United States Patent
O'Donnell

(10) Patent No.: US 6,990,887 B1
(45) Date of Patent: Jan. 31, 2006

(54) PROTECTIVE SHIELD

(76) Inventor: Eugene O'Donnell, 6109 N. Willow Pond Dr., Fredericksburg, VA (US) 22407

( * ) Notice: Subject to any disclaimer, the term of this patent is extended or adjusted under 35 U.S.C. 154(b) by 0 days.

(21) Appl. No.: 10/767,821

(22) Filed: Jan. 30, 2004

(51) Int. Cl.
*F41H 5/08* (2006.01)

(52) U.S. Cl. ..... 89/36.07; 89/36.02; 89/36.06

(58) Field of Classification Search ..... 89/36.05, 89/36.02, 36.07, 36.06; 2/2.5; 109/49.5
See application file for complete search history.

(56) References Cited

U.S. PATENT DOCUMENTS

| | | | | | |
|---|---|---|---|---|---|
| 377,732 | A | * | 2/1888 | Adams | 2/2.5 |
| 1,177,888 | A | * | 4/1916 | Norwood | 109/22 |
| 1,279,571 | A | | 9/1918 | Moloney | |
| 1,466,669 | A | | 9/1923 | Martinson | |
| 1,649,996 | A | | 11/1927 | Toth | |
| 2,020,702 | A | | 11/1935 | Russell | |
| 2,109,831 | A | * | 3/1938 | Szalkay | 109/49.5 |
| 3,370,302 | A | | 2/1968 | Karlyn | |
| 3,923,339 | A | | 12/1975 | McDonald | |
| 4,412,495 | A | * | 11/1983 | Sankar | 109/49.5 |
| 5,241,703 | A | * | 9/1993 | Roberts et al. | 2/2.5 |
| 5,293,807 | A | * | 3/1994 | Hajdu | 89/36.07 |
| 5,294,031 | A | * | 3/1994 | Volpei et al. | 224/682 |
| 5,392,686 | A | | 2/1995 | Sankar | |
| 5,829,653 | A | * | 11/1998 | Kaiser | 224/577 |
| 6,131,198 | A | * | 10/2000 | Westrick | 2/102 |
| 6,691,601 | B2 | * | 2/2004 | Cohen et al. | 89/36.05 |

FOREIGN PATENT DOCUMENTS

| | | | |
|---|---|---|---|
| GB | 2 122 732 | A * | 1/1984 |

* cited by examiner

*Primary Examiner*—Stephen M. Johnson

(57) ABSTRACT

A pivotally adjustable shield includes a first member having substantially planar front and rear surfaces and an edge portion integral therewith. The shield further includes a second member having substantially planar front and rear surfaces and an edge portion engageable with the edge portion of the first member. An elongated pin is positioned through a plurality of apertures of the first and second members. An arm brace is connected to the first member and extends rearwardly therefrom and a hand bar is connected to the second member and extends rearwardly therefrom. A Velcro patch or clip is affixed to the second member and a firearm holster is connectable thereto.

3 Claims, 4 Drawing Sheets

PROTECTIVE SHIELD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a shield and, more particularly, to a hand-held and pivotally adjustable bullet guard for protecting a law enforcement officer from gunfire.

2. Prior Art

Recent incidents in the United States and abroad have clearly demonstrated the vulnerability of law enforcement officers, military personnel and citizens to injury from clubs, hurled missiles such as stones, brick and the like, and gunshots, as well as to manual blows. These same people are equally vulnerable to injury from the throwing of acids and other irritants, which have been used as weapons by persons participating in riots. Protection during vehicle stops is a continuing concern for law enforcement officers because of their vulnerability during such situations. Currently, officers have only body armor, which temporarily disable them after impact from gunfire. Moreover, officers typically do not carry additional gear to protect their head, neck, arms and other exposed areas of their body.

While efforts have been made to provide bullet resistant or bulletproof means for vehicles, much of this previous work has involved relatively heavy metal plates in or attached to a vehicle. With reference to the windows of a vehicle, some previous efforts have been made to strengthen these portions of the vehicle and to protect its passengers. However, such constructions may be attached permanently to the vehicle, or they may be of relatively costly construction, or they may have been unsatisfactory in use, or be otherwise objectionable.

Accordingly, a need remains for a lightweight, removable bullet guard to protect a law enforcement officer when he/she is approaching a vehicle on foot or when he/she is seated in their patrol car.

BRIEF SUMMARY OF THE INVENTION

In view of the foregoing background, it is therefore an object of the present invention to provide a pivotally adjustable bullet guard to protect a law enforcement officer from gunfire primarily from a driver and secondarily from a passenger. Such a bullet guard is also useful for military government or private guard posts. It is not intended to be utilized as riot gear. Rather, bullet guard is advantageously shaped like the driver side window of many cars so that is can effectively protect a law enforcement officer seated therein. These and other objects, features, and advantages of the invention are provided by a bullet guard device including a first member, formed from bullet proof material such as Kevlar, for example, and having substantially planar front and rear surfaces. Of course, various bullet proof materials such as bullet proof plastics or rigid materials including a lead core, for example, may be employed, as well-known to a person of ordinary skill in the art.

The first member further has an edge portion integral with the front and rear surfaces and is disposed substantially proximal to a center of the shield. The edge portion may be corrugated and may have a plurality of altering crests and troughs formed therealong. The plurality of crests include a plurality of apertures formed therein and aligned with each other along the edge portion. An arm brace is connected to the first member and extends rearwardly therefrom. Such an arm brace receives an arm of a user therethrough for supporting the first member at a substantially stable position. Advantageously, the arm brace includes a plurality of sides pivotally connected to each other and adaptable to a collapsed position so that the shield can be folded during non-operating conditions.

Advantageously, the present invention further includes a second member, also formed from bullet proof material such as Kevlar, for example, and has substantially planar front and rear surfaces and an edge portion that may be engaged with the edge portion of the first member. Similar to the first member, various bullet proof materials such as bullet proof plastics or rigid materials including a lead core, for example, may be employed, as well-known to a person of ordinary skill in the art. The edge portion may be corrugated and may have a plurality of altering crests and troughs that are engageable with corresponding ones of the plurality of crests and troughs of the first member. The plurality of crests of the second member may include a plurality of apertures formed therein and aligned with each other and with the plurality of apertures of the first member.

The present invention further includes a hand bar connected to the second member and extending rearwardly therefrom. The hand bar may be selectively engageable by an operator for supporting the second member. Furthermore, a Velcro patch may be affixed adjacent to the hand bar on the second member and a firearm holster may be removably connected thereto. Alternately, a clip, well-known in the industry, may be affixed to the second member for receiving the holster on the back side of the shield. The first and second members are preferably formed from a plurality of layers secured to each other wherein the first member may have a generally triangular shape and the second member may have a generally rectangular shape.

An elongated pin may be positioned through the plurality of apertures of the first and second members for maintaining same pivotally engaged with each other so that the shield can be adapted between altering positions. The pin has a spring member disposed thereabout for advantageously causing the first and second members to become disposed substantially parallel to each other when a user opens the shield.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
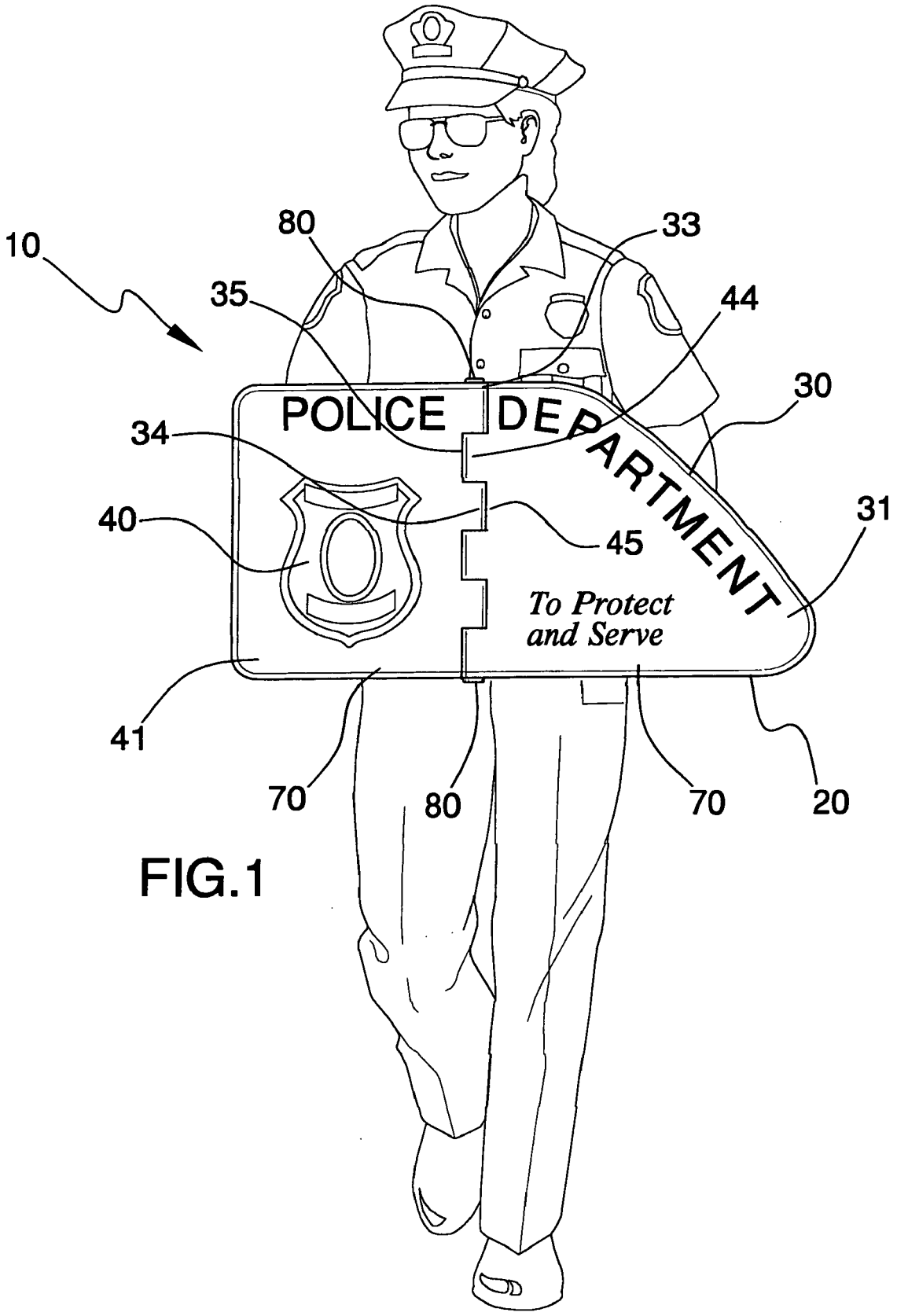
FIG. 1 is a front elevational view showing a pivotally adjustable protective shield, in accordance with the present invention.
Figure 2:
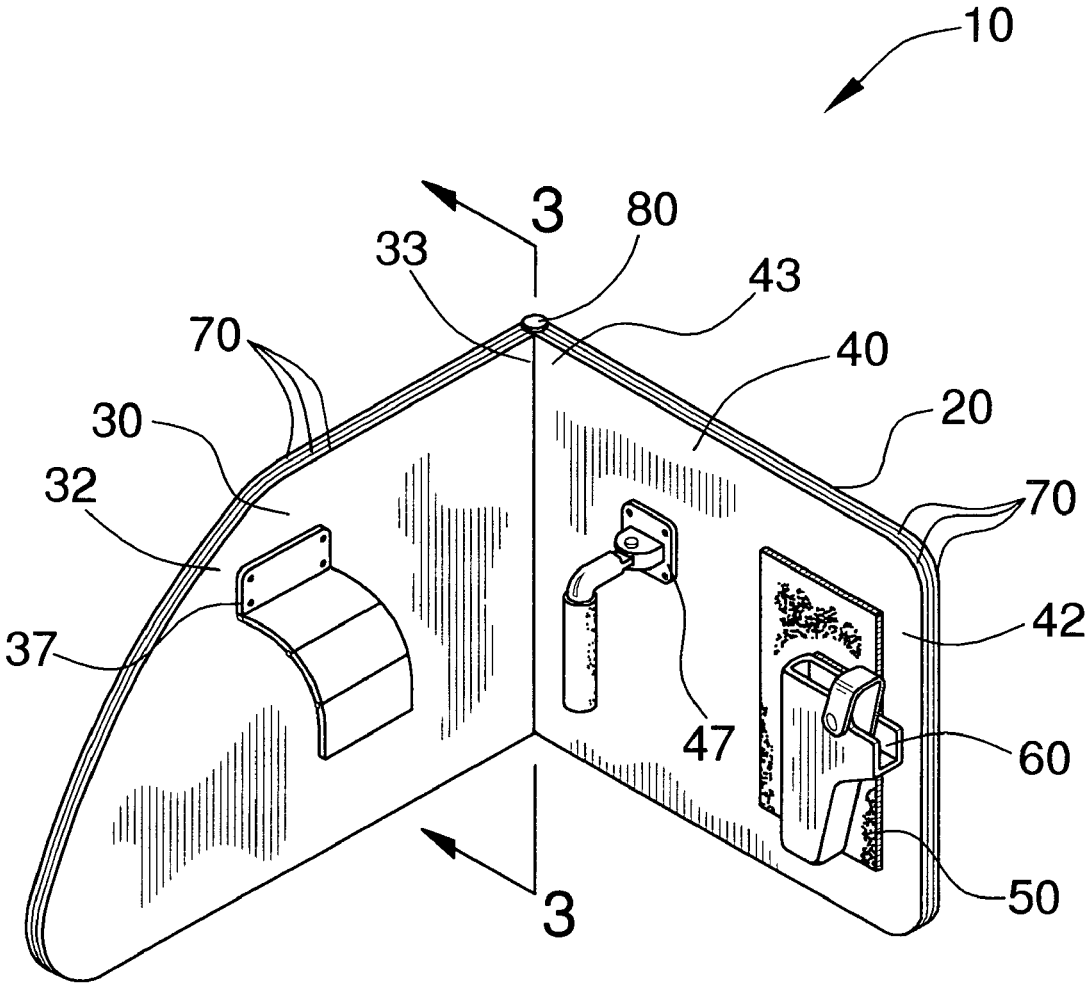
FIG. 2 is a perspective rear-end view of the device shown in FIG. 1.
Figure 3:
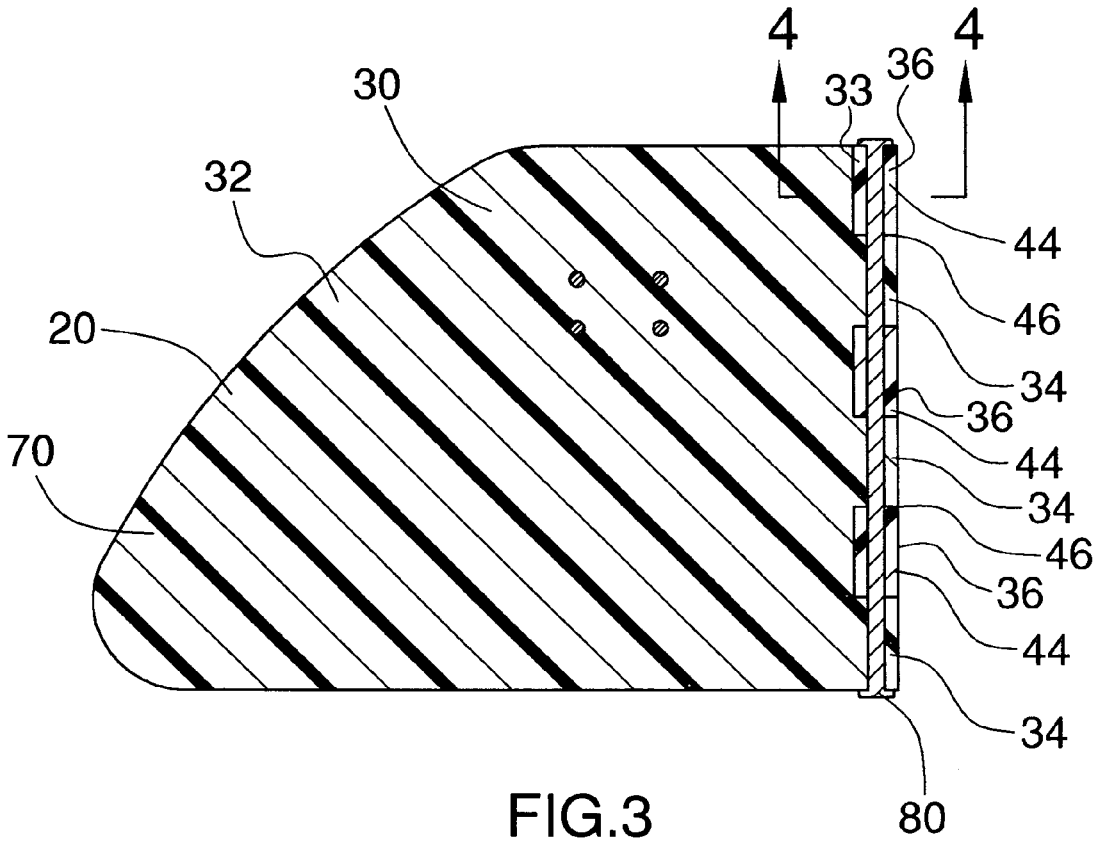
FIG. 3 is a cross-sectional view of the device shown in FIG. 1 taken along line 3—3 in FIG. 2.
Figure 4:
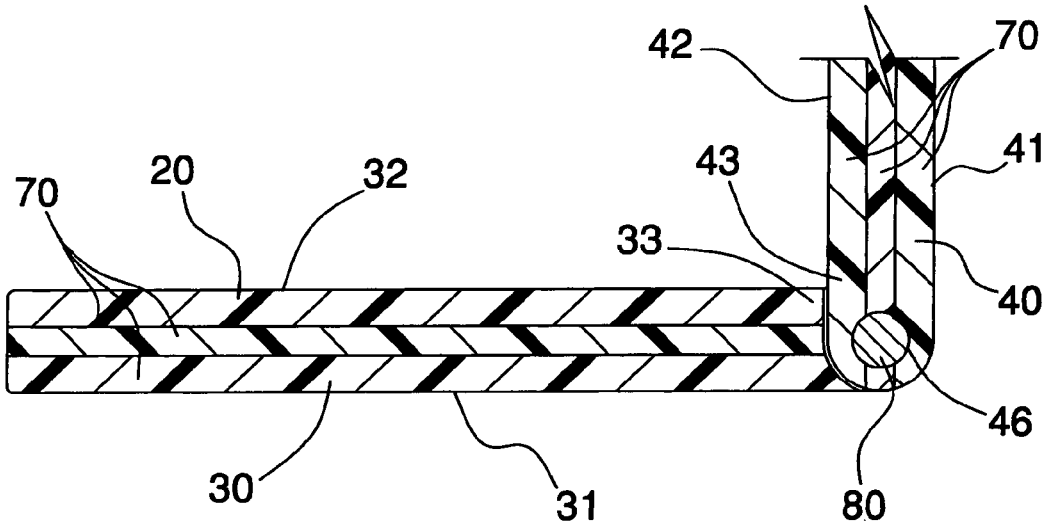
FIG. 4 is a cross-sectional view of the device shown in FIG. 1 taken along line 4—4 in FIG. 3.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–4 by the reference numeral 10 and is intended to provide a pivotally adjustable protective shield. It should be understood that the device 10 may be employed by many different industries and therefore should not be construed as being employable only by a law enforcement agency.

Referring initially to FIG. 1, a protective shield 20 device 10 including a first member 30, formed from Kevlar or other bullet proof material well-known in the industry, and having substantially planar front 31 and rear 32 surfaces. The first member 30 further has an edge portion 33 integral with the front 31 and rear 32 surfaces and disposed substantially proximal to a center of the shield 20. The edge portion 33 is corrugated and has a plurality of altering crests 34 and troughs 35 formed therealong. The plurality of crests 34 include a plurality of apertures 36 formed therein and aligned with each other along the edge portion 33. A collapsible arm brace 37 is connected to the first member 30 and extends rearwardly therefrom. Such an arm brace 37 receives an arm of a user therethrough for supporting the first member 30 at a substantially stable position.

Advantageously, the present invention further includes a second member 40, formed from Kevlar or other bullet proof material well-known in the industry, having substantially planar front 41 and rear 42 surfaces and an edge portion 43 that is engaged with the edge portion 33 of the first member 30. The edge portion 43 may be corrugated and may have a plurality of altering crests 44 and troughs 45 that are engageable with corresponding ones of the plurality of crests 34 and troughs 35 of the first member 30. The plurality of crests 44 of the second member 40 includes a plurality of apertures 46 formed therein and aligned with each other and with the plurality of apertures 36 of the first member 30.

The present invention further includes a hand bar 47 connected to the second member 40 and extending rearwardly therefrom. The hand bar 47 is selectively engageable by an operator for supporting the second member 40. Furthermore, a Velcro patch 50 or conventional clip is affixed adjacent to the hand bar 47 on the second member 40 and a firearm holster 60 is removably connected thereto. The first 30 and second 40 members are formed from a plurality of layers 70 secured to each other wherein the first member 30 may have a generally triangular shape and the second member 40 may have a generally rectangular shape.

An elongated pin 80 is positioned through the plurality of apertures 36, 46 of the first 30 and second 40 members for maintaining same pivotally engaged with each other so that the shield 20 can be adapted between altering positions. The pin 80 also has a spring member 81 disposed thereabout for advantageously causing the first 30 and second 40 members to become disposed parallel to each other.

The appealing features of the protective shield 20 are the combination of the ballistic shield protection feature, the shape, the size, the folding design, and the location of the forearm brace 37 and hand bar 47. When carried in the hand, the protective shield 10 can be quickly raised to protect the carrier while approaching a vehicle.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A shield for protecting a law enforcement officer at vehicle stops and comprising:

a first member including substantially planar front and rear surfaces and an edge portion integral therewith and disposed substantially proximal to a center of said shield, said edge portion being corrugated and having a plurality of altering crests and troughs formed therealong, said plurality of crests including a plurality of apertures formed therein and aligned with each other along said edge portion;

a second member including substantially planar front and rear surfaces and an edge portion engageable with said edge portion of said first member, said edge portion of said second member being corrugated and having a plurality of altering crests and troughs engaged with corresponding ones of said plurality of crests and troughs of said first member, said plurality of crests of said second member including a plurality of apertures formed therein and aligned with each other and with said plurality of apertures of said first member;

an elongated pin positioned through said plurality of apertures of said first and second members for maintaining same pivotally engaged with each other so that said shield can be adapted between altering positions;

a collapsible arm brace connected to said first member and extending rearwardly therefrom, said arm brace for receiving an arm of a user therethrough for supporting said first member;

a hand bar connected to said second member and extending rearwardly therefrom, said hand bar engageable by an operator for supporting said second member;

one of a clip and a Velcro patch affixed to said second member; and a firearm holster removably connected thereto and adjacent said hand bar.

2. The shield of claim 1, wherein said first and second members further comprise:

a plurality of layers formed from bullet proof material and being secured to each other.

3. The shield of claim 1, wherein said first member has a generally triangular shape and said second member has a generally rectangular shape.

* * * * *